US007997100B2

(12) United States Patent
Fossas

(10) Patent No.: US 7,997,100 B2
(45) Date of Patent: Aug. 16, 2011

(54) JEWELRY WITH HIDDEN COMPARTMENT

(76) Inventor: Jeanette Fossas, San Juan, PR (US)

( * ) Notice: Subject to any disclaimer, the term of this patent is extended or adjusted under 35 U.S.C. 154(b) by 0 days.

(21) Appl. No.: 12/379,219

(22) Filed: Feb. 17, 2009

(65) Prior Publication Data

US 2009/0151392 A1 Jun. 18, 2009

Related U.S. Application Data

(63) Continuation of application No. 11/889,496, filed on Aug. 14, 2007, now abandoned.

(51) Int. Cl.
*A44C 15/00* (2006.01)

(52) U.S. Cl. ..... 63/1.14; 63/4; 206/19

(58) Field of Classification Search ..... 63/1.14, 63/1.18, 1.17, 3, 18, 19, 20, 23, 33, 40
See application file for complete search history.

(56) References Cited

U.S. PATENT DOCUMENTS

| | | | | | |
|---|---|---|---|---|---|
| 1,112,640 | A * | 10/1914 | Mix | 63/19 |
| 1,286,911 | A * | 12/1918 | Bakula | 63/1.14 |
| 1,350,070 | A * | 8/1920 | Couture | 63/18 |
| 1,649,086 | A * | 11/1927 | Spillane | 206/19 |
| 2,721,398 | A * | 10/1955 | Alonso et al. | 434/246 |
| 3,415,079 | A * | 12/1968 | Tomchin | 63/23 |
| 6,546,750 | B1 * | 4/2003 | Bolster et al. | 63/3 |
| 7,322,213 | B2 * | 1/2008 | Tamir et al. | 63/23 |
| 2003/0182963 | A1 * | 10/2003 | Beatty | 63/1.14 |

* cited by examiner

*Primary Examiner* — Jack W. Lavinder
(74) *Attorney, Agent, or Firm* — Merek, Blackmon & Voorhees, LLC

(57) ABSTRACT

An article of jewelry preferably in the form of a pendant having a hollow compartment therein which is accessible by a threaded or press fitted cap which upon opening the container permits access to an article retaining apparatus. The article retaining apparatus can be solid, hollow or formed of a mesh material which permits visibility of the retained object and includes a slot for insertion of a retained object. The article retained may be an object having a reference to luck, power, love or protection and may include either hair or paper or small object.

4 Claims, 4 Drawing Sheets

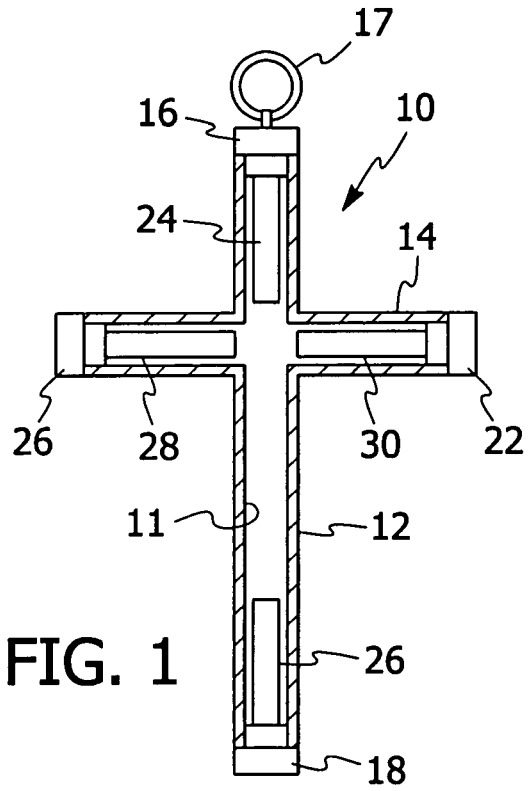
FIG. 1
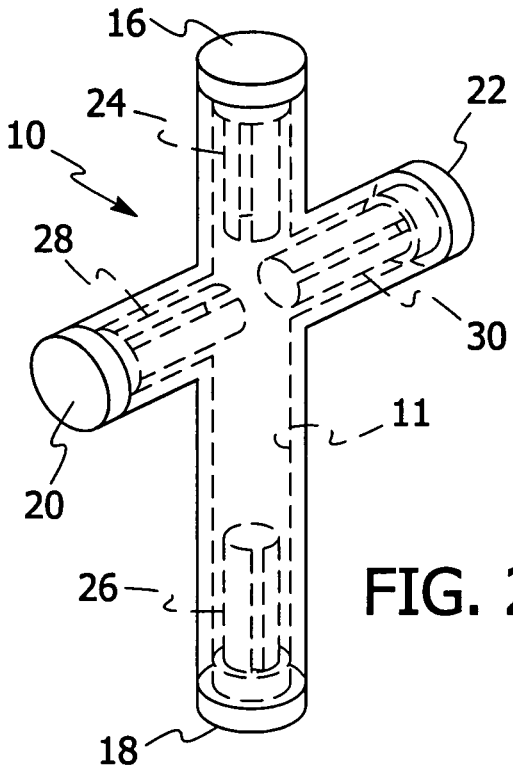
FIG. 2
FIG. 3
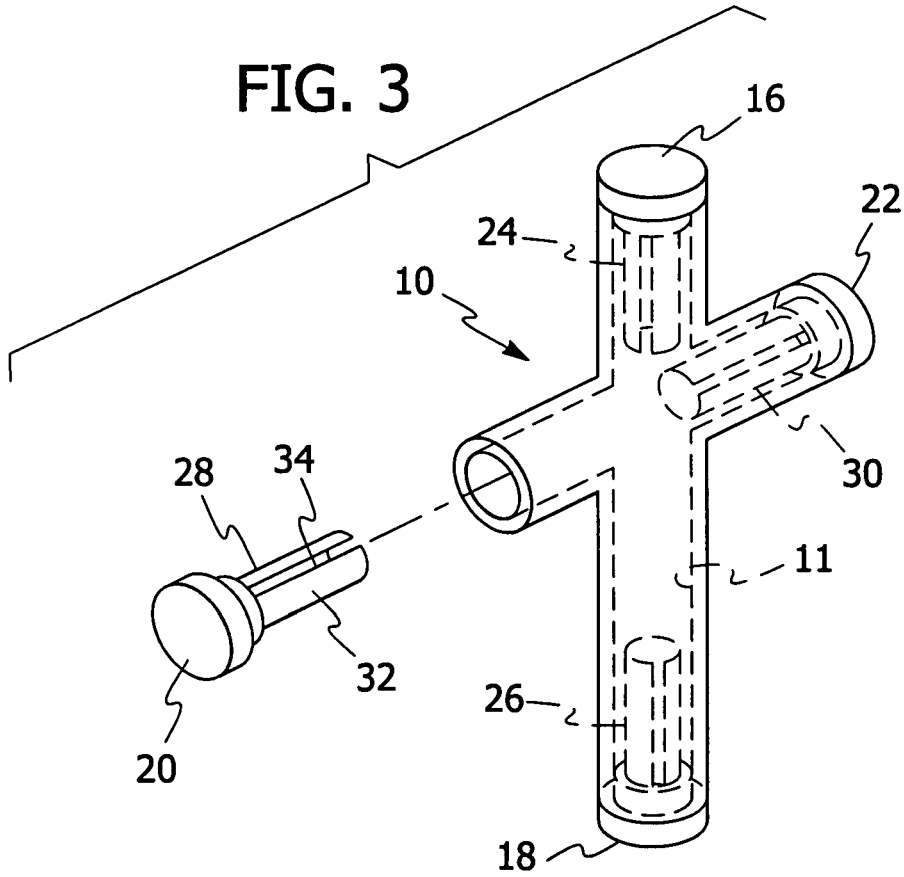

JEWELRY WITH HIDDEN COMPARTMENT

This application is a continuation of and claims the benefit of the filing date of U.S. patent application Ser. No. 11/889,496 filed Aug. 14, 2007 now abandoned.

FIELD OF THE INVENTION

The present invention relates to jewelry and particularly to necklaces and suspended ornaments having a storage compartment.

BACKGROUND OF THE INVENTION

Lockets and other jewelry have been known to have compartments therein for retaining photographs or other objects, in fact, even in Victorian times brooches and lockets were used to retain a lock of hair in a compartment. Other uses for pendants have included containers for perfumes, medications or cremation ashes. Human nature has always searched for love, health and wealth. Religion and spiritual or supernatural beliefs give answers and guidance to these searches. These; give birth to all kinds of magical beliefs and superstitions and; create rituals, amulets, and good luck charms.

An example are the Milagros; which are offered to saints as a reminder of the petitioner's need. For a sore arm, a tiny silver arm is hung on the saint; for a pig to bear many piglets, the owner will pin a pig milagro on the saint's robe. Each Saint is known for different attributes; San Francis is known to help with animals and Saint Anthony to find lost objects, so; people will request the saint according to the need. Iberians in Spain before Christ, used similar Milagros to the ones employed today in Spain, other Mediterranean countries and most Latin America.

Inspired by the milagros tradition and responding to a portable need; due to traveling and lack of space: a functional, "carry on", new kind of jewelry item was designed. The person asking for the grace, can carry the Saint image, cross, or any other form of jewelry and insert in it a small "miracle" or paper with the name of the beloved or whatever icon or good luck charm he chooses to conceal as a reminder; and still keep it so private nobody else will know.

Designs for these containers have focused on various aspects including ornamental design and container closure apparatus. However, none of the prior pendant designs have focused on an object retention apparatus within the container.

In view of the foregoing it can be seen that there is a need for a device for secure concealment of a memento or icon within a piece of jewelry, within a mechanism that is in essence very different from traditional forms that have been used for such purposes. The peculiar designs of the various holding mechanisms, which allow at once for the safekeeping, accessibility, and concealment of the object, without interfering with the outward form and design of the article of jewelry, represent both innovative and practical means to achieve such purposes.

OBJECTS AND SUMMARY OF THE INVENTION

It is an object of the invention to provide an article of jewelry with a compartment having retaining apparatus therein.

It is yet another object of the invention to provide a hidden article retaining apparatus which.

Still another object of the invention is to provide an article retaining apparatus having a slot for receiving an object therein.

Yet another object of the invention is to provide a pendant having a compartment for receiving the article retaining apparatus.

Still another object of the invention is to provide a pendant in the shape of a cross.

In summary, the invention is a mechanism designed to retain a keepsake, such as a memento or good-luck item, concealed within an article of jewelry by means of a hollow space and an insertion device held in place by means of a concealable system involving, alternatively, a screw, a clasp, or other locking mechanism. The insertion device involves a type of male-female system with a variety of holding mechanisms that will serve to hold in place the keepsake item (for example a piece of paper, a lock of hair, or any other small memento). Two alternative designs are provided, the first is designed to hold a lock of hair, a small piece of paper, or another type of small, flexible memento like a chain or ribbon. The first alternative includes a slot in an elongated holder for the insertion of a flexible object. One end of the object will be inserted on the slot and the remainder of the object is wrapped about the elongated holder. The second design includes an empty compartment designed to receive various amulets, milagros or souvenirs. The compartment may also included a guiding rail to assist in retention of the inserted items. These two designs may also be used in combination to retain diverse items. The invention is intended for use within any article of jewelry on which it may, because of its shape, be adapted with sufficient space to hold a small keepsake. Examples are a Christian Cross or a Jewish Star of David, a saint medallion but is not to be limited to religious objects or icons. It may similarly be used in letter-shaped pendants, bracelets, or other designs. The invention draws for inspiration from the tradition of concealing things of personal and sentimental value within items of jewelry kept close to one's person, ideally one's heart or wrist.

Innovative aspects of the invention are the ability to provide a mechanism by means of which the wearer can extract the object held within the device by means of a simple turn of a screwing device or loosening of a clasp, while yet having the object retain its integrity as an article of jewelry that does not at first appearance resemble the form of a traditional reliquary or brooch.

In summary, the invention is directed to an insertion and retaining device, including but not limited to the hollow space, the various retaining devices, and the concealed locking mechanisms to be used in jewelry design as a way to hold keepsakes of different kinds within various forms of wearable jewelry. The invention, in other words, can turn an ordinary object of jewelry into a reliquary by means of a system that does not interfere with the outward appearance of the piece.

BRIEF DESCRIPTION OF THE DRAWINGS

FIG. 1 plan view of a cross of FIG. 2 with portions broken away to reveal the retaining devices therein;

FIG. 2 is a perspective view of a cross showing article retaining apparatus therein;

FIG. 3 shows the cross of FIG. 2 having an end cap and retaining apparatus separated from the body of the cross;

DETAILED DESCRIPTION OF THE INVENTION

Figure 4:
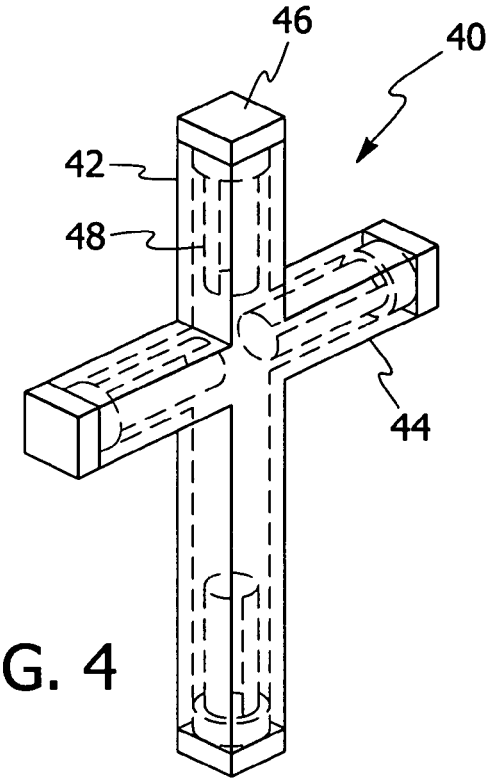
FIG. 4 is a second embodiment of the invention.

Now with reference to FIGS. 1-3, a pendant 10 is shown having a cross shape. The pendant 10 may be formed of other shapes which permit a hollow interior 11 and may be constructed of gold, silver or other metals or other shape holding materials such as wood or plastic or such materials in combination. The pendant 10 includes a round post 12 and a round transom 14. The post 12 includes a top cap 16 having an attaching ring 17 and a bottom cap 18. The transom 14 includes a left cap 20 and a right cap 22. Each cap 16, 18, 20, and 22 are retained in place through either screw threads or a press fit connection. Connected to each cap 16, 18, 20 and 22 is an article retaining apparatus 24, 26, 28 and 30, respectively. Alternatively, the pendant 10 may contain only a single retaining apparatus. Each of the retaining apparatus includes preferably an elongated tube 32 which may be solid or formed from a mesh screen. The screen material allows for charms such as hair or paper to be visible through the mesh screen. The charm may be a symbol for love, power, protection or luck such as a lock of hair or a slip of paper having a message thereon. A slot 34 is formed along the length of the tube 32. The slot 34 allows a length or lock of hair or other object such as paper to be inserted into the tube 32. The tube 32 facilitates retention of the retained object.

Alternatively, a pendant 40 as shown in FIG. 4, wherein each of the post 42 and transom 44 may have only one removable cap 46 respectively and tubular retaining apparatus 48. The post 42 and transom 44 are shown as having square cross-sections.

Figure 5:
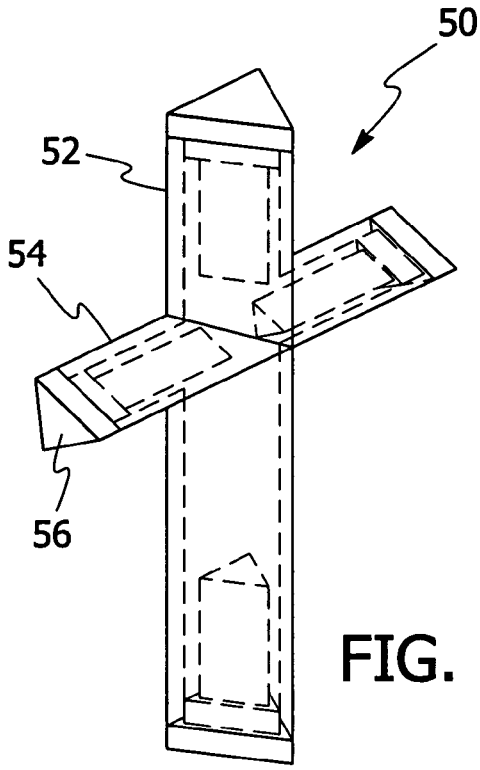
FIG. 5 is a third embodiment of the invention.

Alternatively, as shown in FIG. 5, a pendant 50 is shown wherein each of the post 52 and transom 54 have triangular cross sections as shown by the end caps 56.

Figure 6:
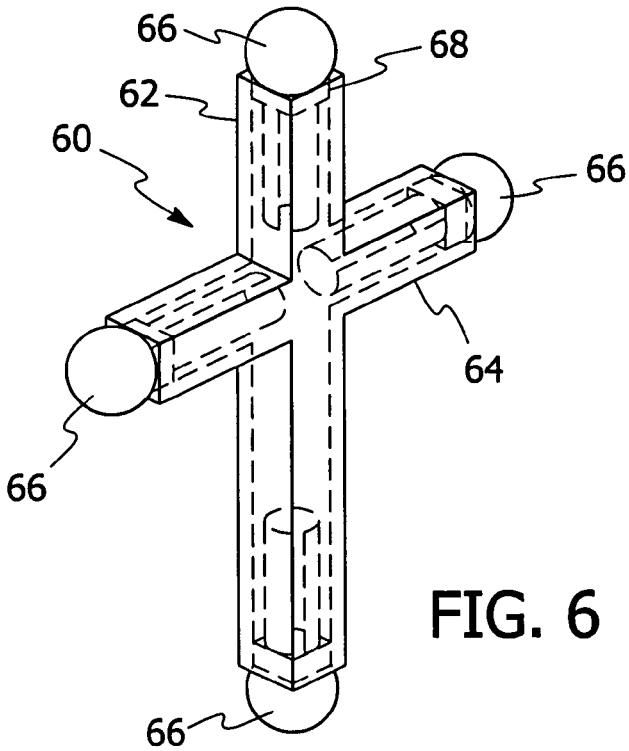
FIG. 6 is a fourth embodiment of the invention.

Alternatively, as shown in FIG. 6, a pendant 60 is shown wherein each of the post 62 and transom 64 have square cross sections, but the caps 66 have a ball shape with a square plug 68 for retaining the caps 66.

Figure 7:
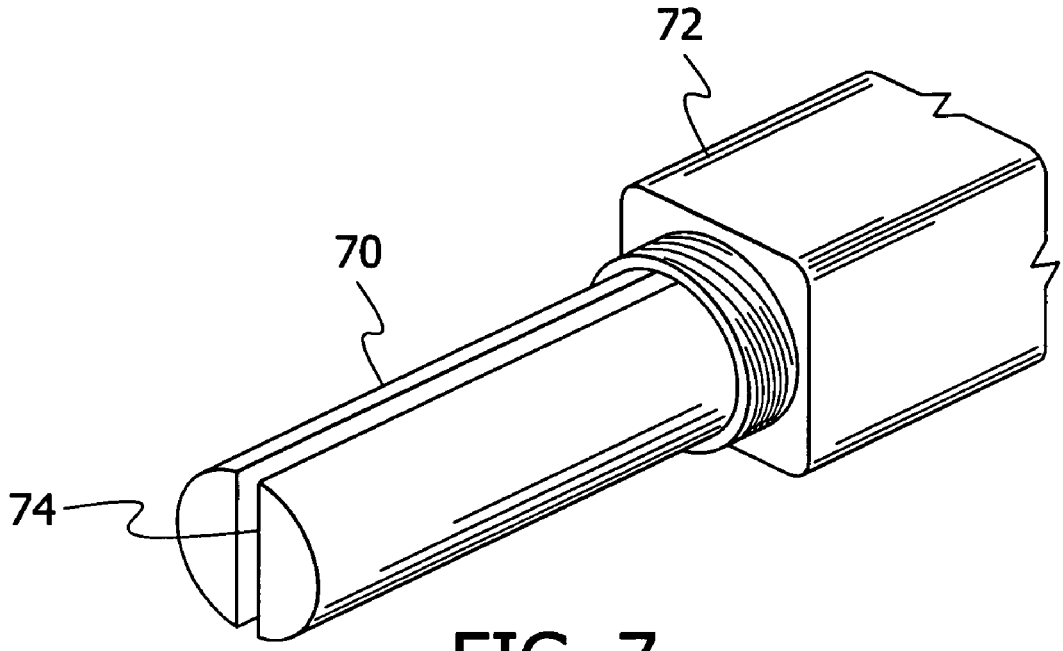
FIG. 7 shows an embodiment having a slot retaining apparatus.
Figure 8:
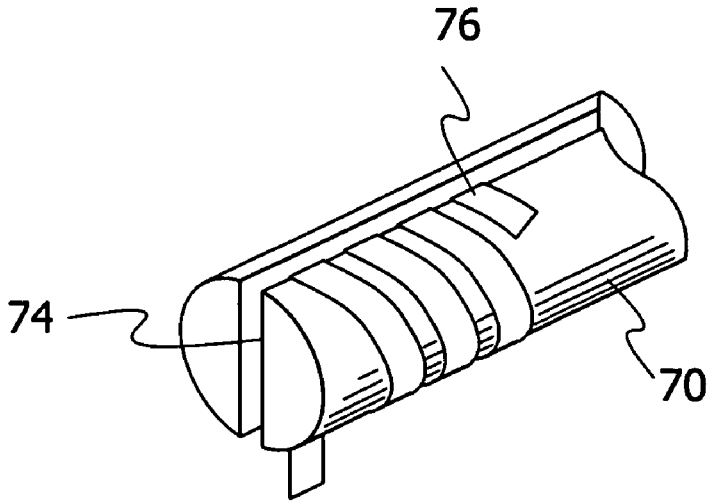
FIG. 8 show the embodiment of FIG. 8 with a ribbon held in the slot.

Now with reference to FIG. 7, the tube 70 is shown in greater detail. Tube 70 may be slidable within a portion of an article of jewelry 72 and have a slot 74 for retaining a charm 76 such as a ribbon as shown in FIG. 8. Various other articles may be retained in the slot such as a chain, hair or paper, etc. The tube 70 can be retracted within a recess 78 in the article of jewelry 72.

Figure 9:
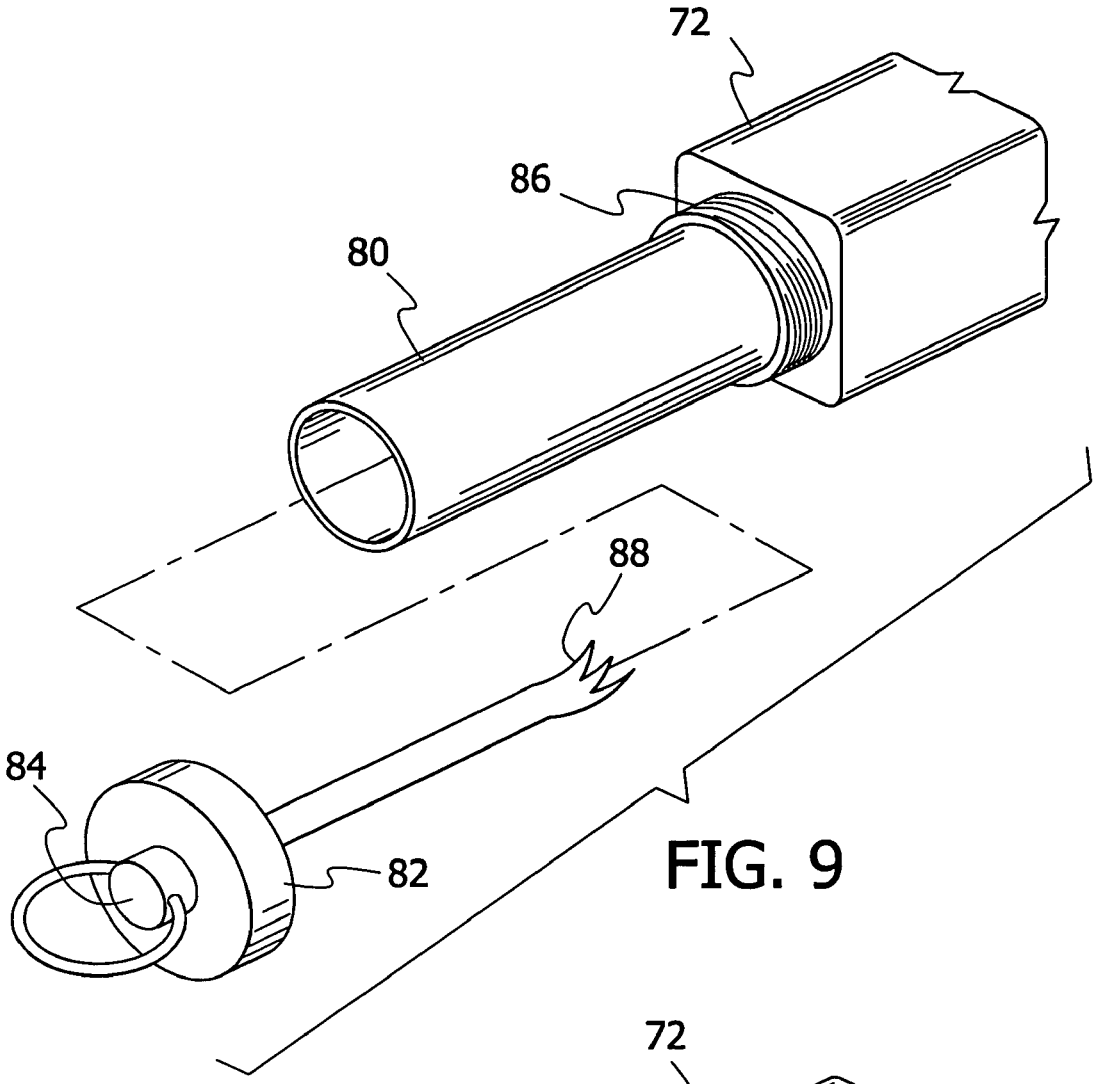
FIG. 9 show an embodiment having a hollow receptacle and a cap.
Figure 10:
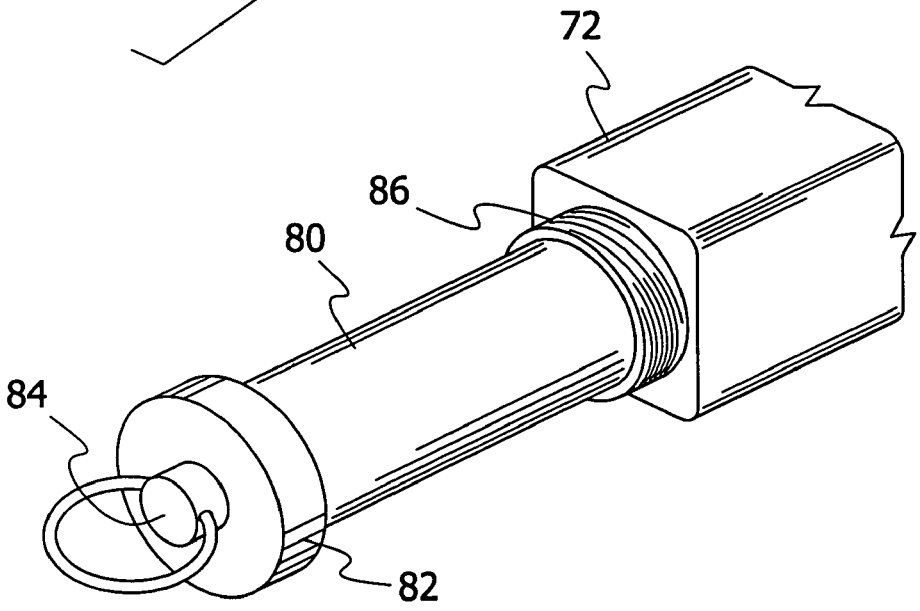
FIG. 10 shows the embodiment of FIG. 10 with the cap attached.

Now with reference to FIGS. 9 and 10, the article of jewelry 72 may include a hollow tube 80 for retaining a charm. The tube 80 is slidable to be received within the article of jewelry 72. A cap 82 having a handle 84 is securely attachable to the article of jewelry 72 by cooperating threads 86 on the article of jewelry 72 and on the interior of the cap 82 (not shown). The cap 82 may also include a retrieval device 88 for assisting in retracting the retained object.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims.

I claim:

1. An article of jewelry for wearing on a person's body for retaining a hidden object, comprising:

a) a hollow body portion connected to a loop of material for retaining said hollow body portion on a wearer;

b) said hollow body portion forms a cross having a vertical hollow portion having a top end and a bottom end and a horizontal hollow portion having a first end and a second end; and c) each of said top, bottom, first and second ends having a removeable cap having an article retaining apparatus connected thereto whereby four article retaining openings are created when each of said removeable caps are removed, d) each of said article retaining apparatus being receivable within said top, bottom, first and second ends; and, e) each of said removeable caps engage one of said top, bottom, first and second ends by a friction fit;

f) each of said removeable caps having an end portion of greater width than its respective opening and a second portion having a width relative to said opening such that said second portion of each of said caps frictionally engages an interior wall of said respective opening and said second portion is adjacent said end portion;

g) said article retaining apparatus extending from said second portion and having a smaller width than said second portion to permit insertion of the article retaining apparatus within one of said openings.

2. The article of jewelry as set forth in claim 1, wherein:

a) said article retaining apparatus forms a hollow container for receiving and retaining a charm.

3. The article of jewelry as set forth in claim 1, wherein:

a) said article retaining apparatus is formed of a tube.

4. The article of jewelry as set forth in claim 3, wherein:

a) said tube includes a slot formed therein for facilitating retention of an object.

* * * * *